US005509844A

United States Patent [19]

Poirier et al.

[11] Patent Number: 5,509,844

[45] Date of Patent: Apr. 23, 1996

[54] LEGLESS STORAGE AND PLAY TABLE FOR USE BY CHILDREN

[76] Inventors: Michael Poirier; Mariann Poirier; Evan Poirier; Jordan Poirier, all of 61-37th Street, Toronto, Ontario M8W 3L5, Canada

[21] Appl. No.: 366,839

[22] Filed: Dec. 30, 1994

[51] Int. Cl.[6] ..... A63H 33/00; A63H 33/04; A63H 33/30

[52] U.S. Cl. ..... 446/71; 446/75; 446/482; 108/43; 108/25

[58] Field of Search ..... 446/71, 2, 73, 446/75, 76, 118, 128, 482; 108/43, 25, 26

[56] References Cited

U.S. PATENT DOCUMENTS

| | | | |
|---|---|---|---|
| 741,903 | 10/1903 | Gates | 446/71 X |
| 2,555,547 | 6/1951 | Kelleghan | 106/25 |
| 4,127,948 | 12/1978 | Chin et al. . | |
| 4,427,391 | 1/1984 | Berman | 108/26 X |
| 4,807,538 | 2/1989 | Hoffman . | |
| 4,872,410 | 10/1989 | Lilly | 446/128 X |
| 5,055,081 | 10/1991 | Nayak . | |
| 5,218,912 | 6/1993 | Buske . | |
| 5,238,407 | 8/1993 | Pollock | 434/208 X |
| 5,250,000 | 10/1993 | Boutin et al. . | |
| 5,327,838 | 7/1994 | Beltman | 108/25 |

*Primary Examiner*—Mickey Yu
*Assistant Examiner*—D. Neal Muir
*Attorney, Agent, or Firm*—Jaeckle, Fleischmann & Mugel

[57] ABSTRACT

The present invention comprises legless storage and play table for use by children, comprising a first member operatively arranged to form a first side of the table, the first member having a trough-like section extending outwardly with respect to the table; a second member operatively arranged to form a second side of the table in parallel spaced relationship to the first side, the second member having a trough-like section extending outwardly with respect to the table; a third member operatively arranged to form a third side of the table positioned perpendicularly to the first and second sides, the third member having a trough-like section extending outwardly with respect to the table; a fourth member operatively arranged to form a fourth side of the table in parallel spaced relationship to the third side, the fourth member having a trough-like section extending outwardly with respect to the table; fasteners connecting the four members together to form a rectangularly shaped table, wherein the fasteners comprise flexible mortises; a bottom member operatively arranged to be secured to at least two of the side members; wherein the four members and the bottom member define a storage chamber; and, a top member having a plurality of flexible tenons operatively arranged to engage the flexible mortises to secure the top member to the side members of the table.

6 Claims, 4 Drawing Sheets

Fig. 6
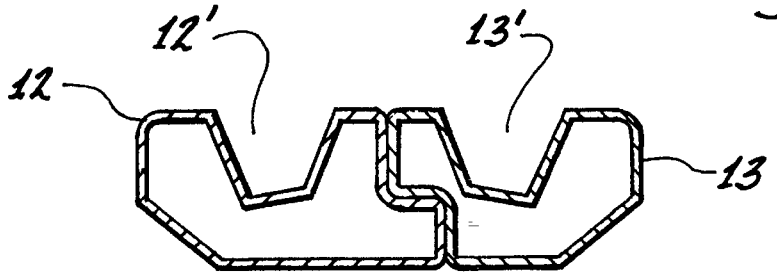
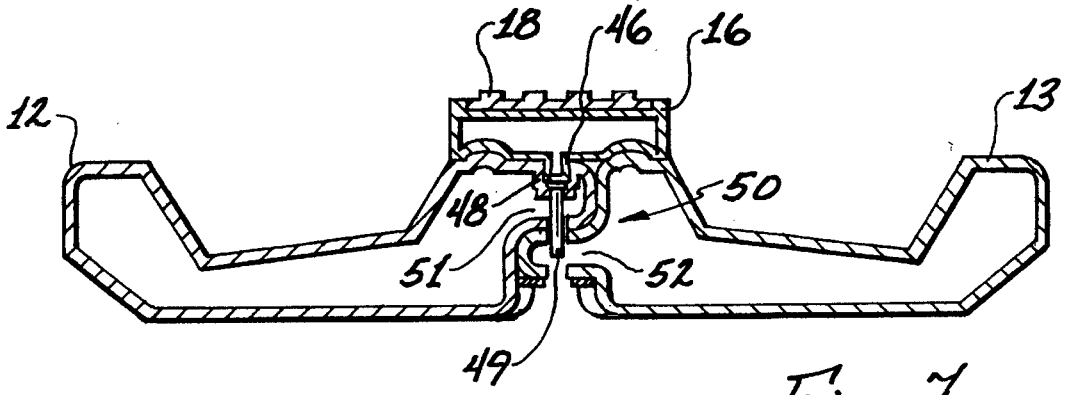
Fig. 7
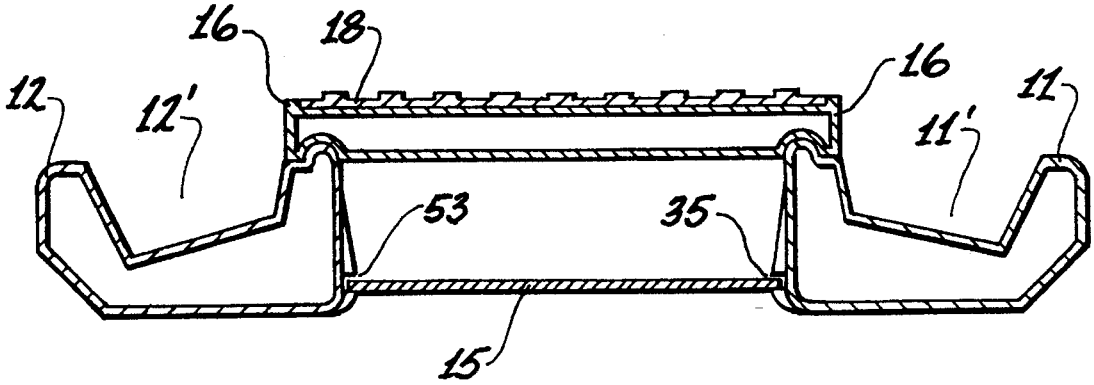
Fig. 8

LEGLESS STORAGE AND PLAY TABLE FOR USE BY CHILDREN

BACKGROUND OF THE INVENTION

The present invention relates to a play table for use by young children. More particularly, the invention relates to a legless storage and play table having a recessed top surface for use in conjunction with a modular building system, and a trough-like catchment about its periphery for toys and the like.

A variety of play tables and desks for children are known in the art. Some of the prior art tables were designed specifically for use with interlocking building blocks (i.e., a modular building system), while others were designed to organize tools, toys and the like, or to provide teaching means. Each of these prior art devices is generally suitable for its intended purpose, but each has its advantages and disadvantages.

Several patents have been directed to tables for use with modular building systems. These systems, which are sold under the trademarks TYCO, DUPLO, LEGO, and TANDEM, generally consist of individual building elements having a variety of sizes and shapes, which elements are capable of interconnecting and interlocking with one another to form a structure. These structures may be static, or may contain moving parts. Advanced systems include motorized mechanisms. These systems are very popular with children because they are fun, and are equally popular with parents because they promote learning and creativity.

U.S. Pat. No. 5,055,081 (Nayak) is directed to a play table and activity center for use with such a modular building system. The table of this invention has a planar top surface having a plurality of recesses to matingly receive interlocking building blocks, and also includes a removable storage chamber accessible through the center of the table. The table has four legs which elevate the playing surface. A disadvantage of this invention is that part of the table playing surface is rendered unusable because of the cavity which accesses the storage chamber. Also, the storage chamber is relatively difficult to access during play. For example, as a child constructs a wall of building blocks about the opening of the storage chamber, using blocks stored in the chamber, it becomes increasingly more difficult to remove blocks from the chamber as the wall gets higher. An alternative is to remove all blocks prior to construction, but this invention offers no neat solution for interim storage or placement of the blocks during play.

In U.S. Pat. No. 5,218,912, Brian Scott Buske has provided a combination storage container and play table for interlocking building blocks where the storage chamber has been conveniently located on the sides of the play surface, thereby solving the problem of the Nayak invention. There are several problems associated with the Buske invention, however. The invention is described as a laptop table, and one would therefore envision that a child would sit with his legs under the table while playing. The table is relatively flat and building blocks can easily fall off the table on any of the four sides. This is especially inconvenient if the blocks fall off the far end of the table, where the child's feet would be.

Boutin et al. disclose a play kit with a detachable play surface in U.S. Pat. No. 5,250,000. This invention is essentially a carrying case with removable play trays, one of which is suitable for use with interlocking building blocks. One of the play trays is intended for laptop use, and is also designed to neatly fit over a table in a hospital room.

Although play tray 16 includes two vertical extension members 42 which stabilize the tray when positioned on a child's lap and prevent play pieces from falling off the sides, the invention includes no provision for preventing play pieces from falling off either end of the play surface.

Hoffman discloses a toy desk unit for organizing learning materials and tools in U.S. Pat. No. 4,807,538. The top of the desk has a plurality of raised retainer means for retaining the materials and tools. A storage chamber is provided under the top. Unfortunately, the top is practically unsuitable for any other purpose than storage of materials and tools of particular dimensions. Moreover, the top is inclined, which renders the desk unusable for use with interlocking building blocks.

Finally, U.S. Pat. No. 4,127,948 (Goy Yu Chin et al.) discloses a play desk in the form of an animated character having a head, two arms, two legs, and a body which comprises an openable compartment. The body portion includes a first play surface textured to function as a chalk board, and a second opposing surface having aligned parallel grooves and slots for receiving removable alphanumeric members. The play surfaces are not suitable for use with interlocking building blocks and the table contains no catchment lip around its edges.

SUMMARY OF THE INVENTION

The present invention comprises a legless storage and play table for use by children, comprising a first member operatively arranged to form a first side of the table, the first member having a trough-like section extending outwardly with respect to the table; a second member operatively arranged to form a second side of the table in parallel spaced relationship to the first side, the second member having a trough-like section extending outwardly with respect to the table; a third member operatively arranged to form a third side of the table positioned perpendicularly to the first and second sides, the third member having a trough-like section extending outwardly with respect to the table; a fourth member operatively arranged to form a fourth side of the table in parallel spaced relationship to the third side, the fourth member having a trough-like section extending outwardly with respect to the table; fastening means for connecting the four members together to form a rectangularly shaped table, wherein the fastening means comprise flexible mortises; a bottom member operatively arranged to be secured to at least two of the side members; wherein the four members and the bottom member define a storage chamber; and, a top member having a plurality of flexible tenons operatively arranged to engage the flexible mortises to secure the top member to the side members of the table.

A primary object of the invention is to provide a play table having a catchment about its periphery for organizing and storing toys and the like during play.

A secondary object is to provide a play table without legs, thereby giving the table a low profile for easier storage (e.g., under a bed, etc.).

A further object is to provide a play table having a storage chamber therein.

Another object is to provide a play table having fastening means which are recessed and unaccesible to small children.

Still a further object is to provide a play table having top member with a recess therein to receive a secondary play surface member compatible with interlocking building blocks.

Still another object is to provide a play table having no sharp edges or points which could be harmful to small children.

These and other objects, advantages and features of the invention will become readily apparent from the following detailed description, drawings and claims.

BRIEF DESCRIPTION OF THE DRAWINGS

FIG. 6 is a sectional view, taken generally along line 6—6 in FIG. 2;

FIG. 7 is a sectional view, taken generally along line 7—7 in FIG. 2;

FIG. 8 is a transverse sectional view, taken generally along line 8—8 in FIG. 2;

DESCRIPTION OF THE PREFERRED EMBODIMENT

Figure 1:
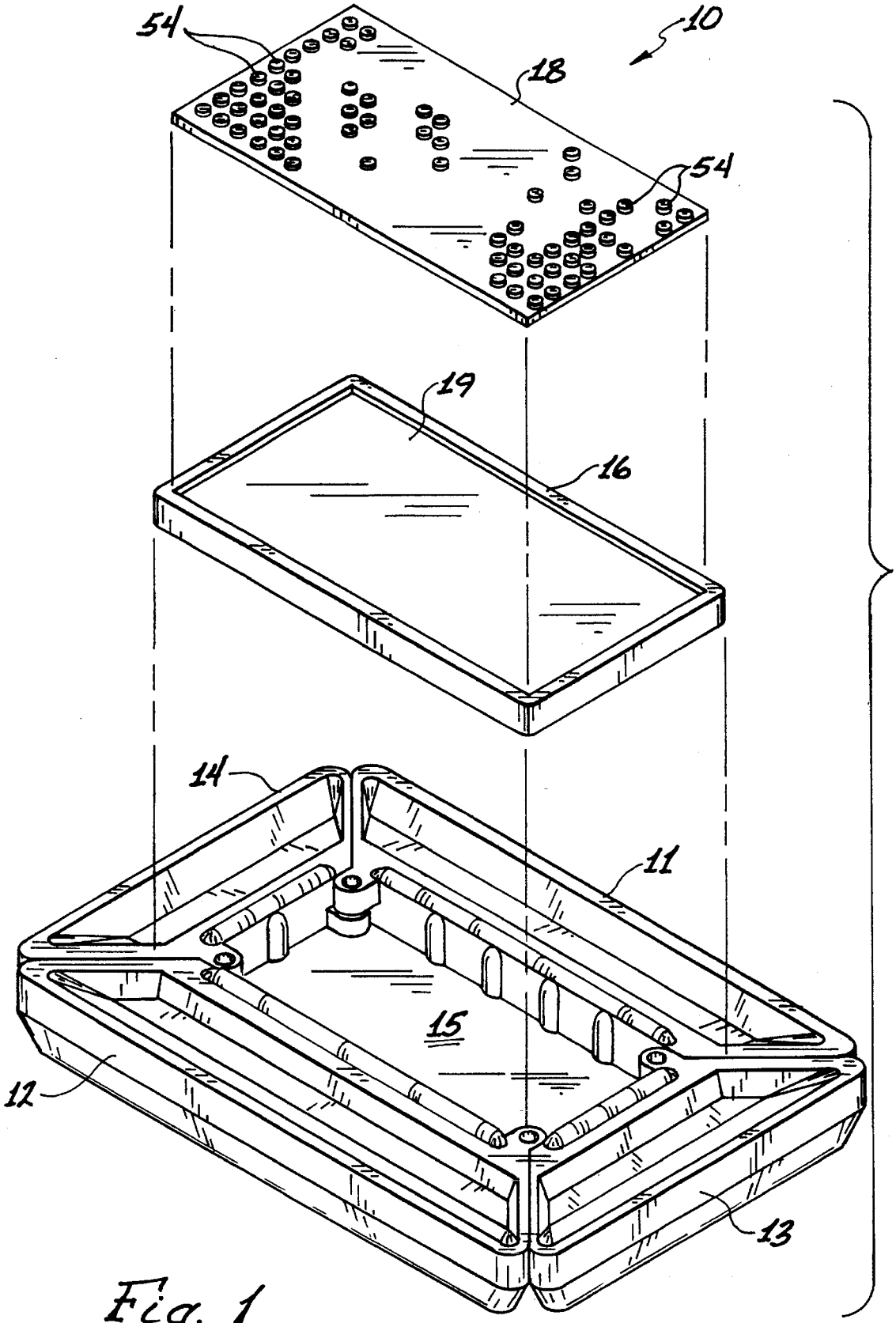
FIG. 1 is an exploded perspective of the invention.

At the outset, it should be clearly understood that the drawings are to be read together with the specification, and are to be considered a portion of the entire "written description" of this invention, as required by 35 U.S.C. §112. Also, identical reference numerals on different figures refer to identical elements of the invention.

The invention generally comprises a legless storage and play table for use by children. In a preferred embodiment, the invention is made of blow-molded plastic, although the invention may be made of other materials as well. The table illustrated in the drawings is rectangular in shape, although obviously the table could be constructed in virtually any shape (round, oval, irregular, etc.).

Adverting now to the drawings, FIG. 1 is an exploded perspective of legless storage and play table 10. The table is shown to comprise first member 11 which forms a first side of the table, second member 12 which forms a second side of the table in parallel spaced relation to the first member, third member 13 which is positioned perpendicularly to the first and second members and is arranged to form a third side of the table, and fourth member 14 in parallel spaced relation to the third member. The four side members are shown to form a rectangularly shaped table. Table 10 also includes bottom member 15 and top member 16. Top member 16 matingly engages the four side members, and is removable to reveal a storage chamber formed by the four side members and the bottom member. Top member 16 has a recessed top surface 19 which matingly receives secondary play surface member 18. Play surface 18 includes a plurality of male nubs 54 which matingly engage corresponding female sections of interlocking building blocks.

Figure 2:
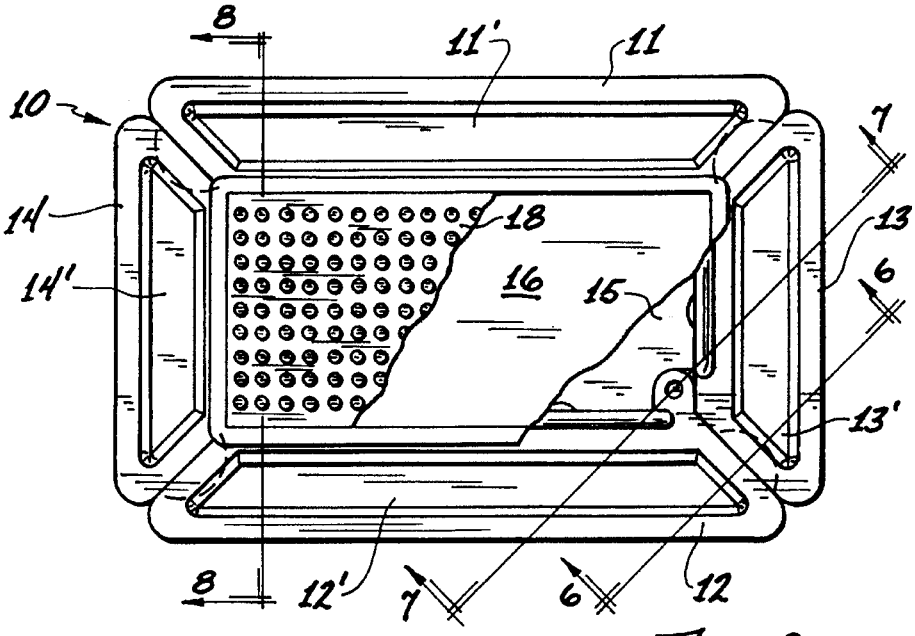
FIG. 2 is a partial cutaway, plan view of the full assembly of the invention.

FIG. 2 is is a partial cutaway plan view of the full assembly of the table 10. This view clearly shows the troughlike sections of each side member, which trough sections function as catchments for toys and the like during play. First side member 11 includes first trough section 11'; second side member 12 includes second trough section 12'; third side member 13 includes third trough section 13'; and fourth side member 14 includes fourth trough section 14'. All trough sections are shown to extend outwardly from the center of the table. Although all troughs are shown to be generally trapezoidal in shape, other shaped troughs could be molded into the side members. It is also envisioned that individual troughs could be divided into subcompartments for separating various toys and the like.

Figure 3:
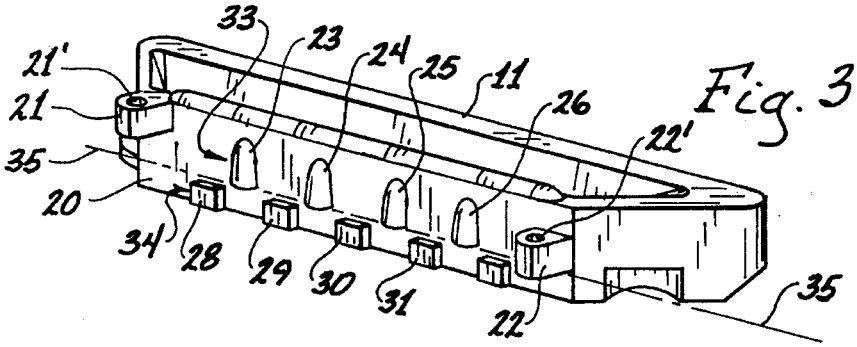
FIG. 3 is a perspective of a first side member of the storage and play table, as viewed from the inside of the table.
Figure 4:
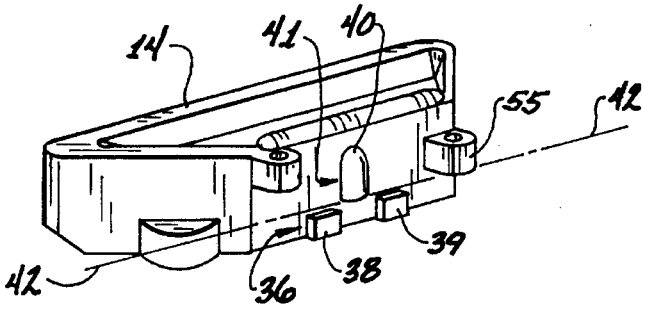
FIG. 4 is a perspective of a fourth side member of the storage and play table, as viewed from the inside of the table.

FIG. 3 is a perspective of first side member 11, as viewed from the inside of the table, and FIG. 4 is a perspective of fourth side member 14, also viewed from the inside of the table. First side member 11 contains inside wall 20. Extending inwardly from wall 20 are upper hinge 21 having through-bore 21' and lower hinge 22 having through-bore 22'. The upper hinge mates with a corresponding lower hinge of an adjacent side member, and the lower hinge mates with a corresponding upper hinge of an adjacent side member. For example, bottom hinge 42 of member 14 is alignable with top hinge 21 of member 11.

Also extending inwardly from wall 20 is a first row 33 of colinear protuberances 23, 24, 25, and 26, and a second row 34 of colinear protuberances 28, 29, 30, 31 and 32. The two colinear rows define a groove (shown as dotted line 35), i.e., a space exists between the tops of the bottom protuberances (second row) and the bottoms of the top protuberances (first row). Bottom member 15 (shown in FIGS. 1 and 28) fits snugly and is retained in place within the groove between the two colinear rows. At least two opposing (or parallel spaced) side members have these colinear rows to support the bottom member, although, in a preferred embodiment, all four side members have these protuberances. In FIG. 4, first row 41 contains only a single protuberance 40, while second row 36 contains protuberances 38 and 39. The two rows define a groove therebetween (shown as dotted line 42). Bottom hinge 55 of member 14 is alignable with top hinge 21 of member 11.

Figure 5:
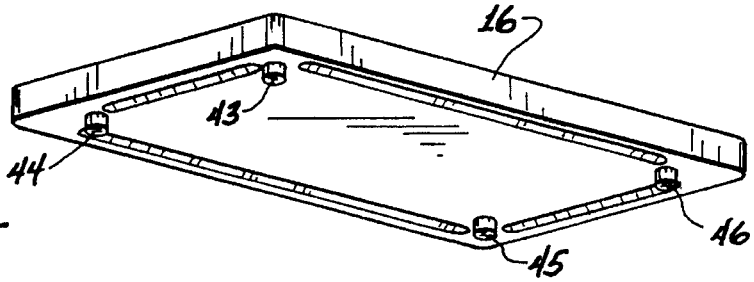
FIG. 5 is a perspective of the top member of the table, as viewed from the bottom of the top member.

FIG. 5 is a perspective of top member 16, illustrating downwardly extending tenons 43, 44, 45 and 46. The tenons engage flexible mortises described infra to hold the top member in place.

FIG. 6 is a sectional view, taken generally along line 6—6 in FIG. 2, illustrating how adjacent side members 12 and 13 interlock.

FIG. 7 is a sectional view, taken generally along line 7—7 in FIG. 2. FIG. 7 illustrates fastening means 50 which comprises screw 49 which secures upper hinge 51 of member 12 to lower hinge 52 of member 13. The fastening means also includes flexible mortise 48 which engages tenon 46 of top member 16. Note that screw 49 is safely recessed and inaccessible to small children. It is envisioned that the screws will be of the same color as the table sides to further hide them from the inquisitive eyes of children. It should be further appreciated that the table as described contains no sharp edges or points which could harm children.

FIG. 8 is a transverse sectional view, taken generally along line 8—8 in FIG. 2. This view illustrates parallel spaced side member 11 and 12, and also illustrates how bottom member 15 fits snugly in groove 35 of member 11 and groove 53 of member 12. It also shows how top member 16 matingly engages the side members, and clearly shows how secondary play surface member 18 fits in the recess of top member 16.

Figure 9:
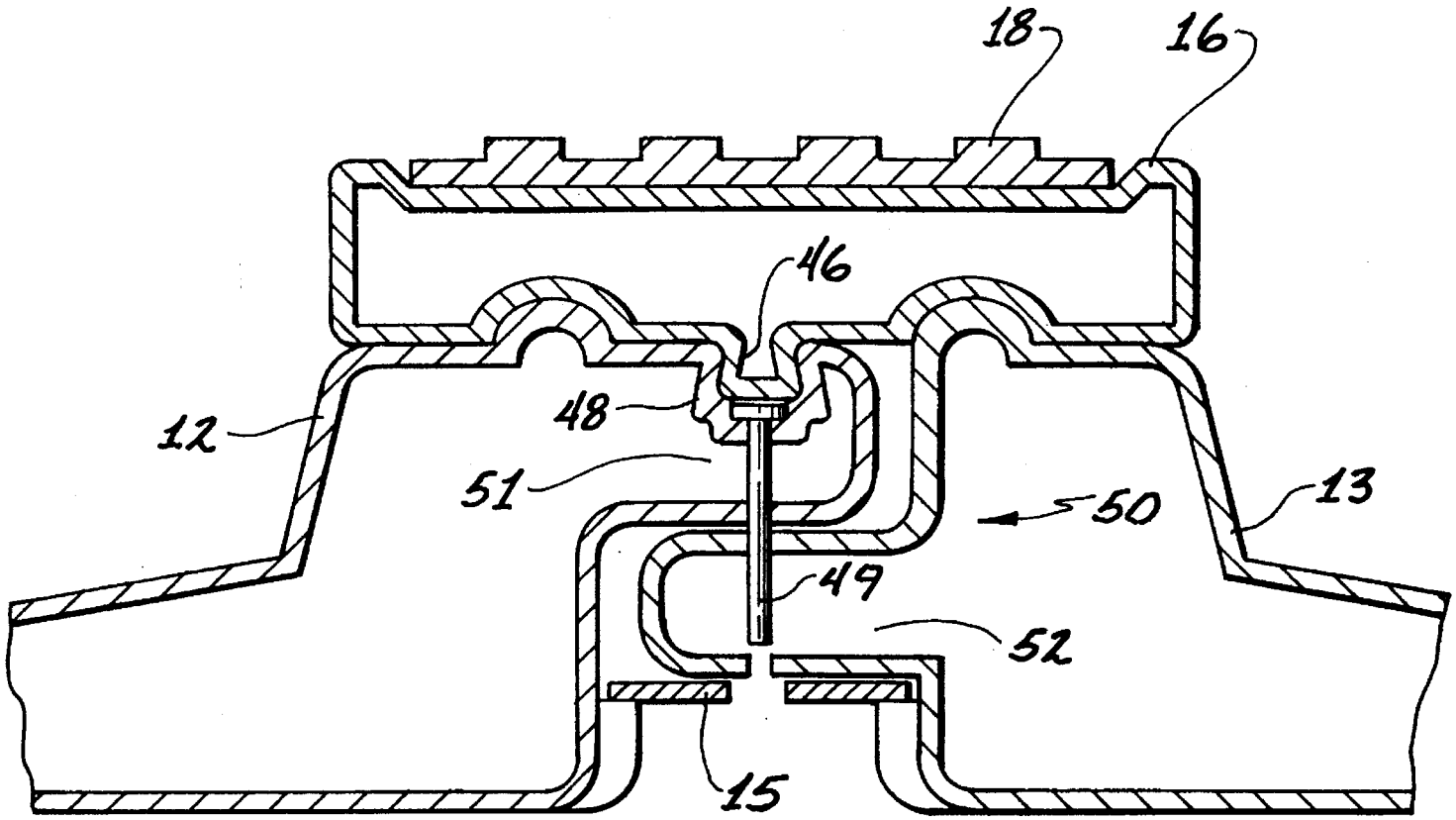
FIG. 9 is an enlarged view of the fastening means outlined in dotted lines in FIG. 7.

Finally, FIG. 9 is an enlarged view of the sectional view shown in FIG. 7, to better illustrate the intricacies of the fastening means.

It will be understood that the foregoing description is illustrative of the invention and should not be considered as limiting and that other embodiments of the invention are possible without departing from the invention's spirit and scope, as embodied in the following claims.

What is claimed is:

1. A legless storage and play table for use by children, comprising:

a first member operatively arranged to form a first side of said table, said first member having a trough-like section extending outwardly with respect to said table;

a second member operatively arranged to form a second side of said table in parallel spaced relationship to said first side, said second member having a trough-like section extending outwardly with respect to said table;

a third member operatively arranged to form a third side of said table positioned perpendicularly to said first and second sides, said third member having a trough-like section extending outwardly with respect to said table;

a fourth member operatively arranged to form a fourth side of said table in parallel spaced relationship to said third side, said fourth member having a trough-like section extending outwardly with respect to said table;

fastening means for connecting the four members together to form a rectangularly shaped table, wherein said fastening means comprise flexible mortises;

a bottom member operatively arranged to be secured to at least two of said side members;

wherein said four members and said bottom member define a storage chamber; and, a top member having a plurality of tenons operatively arranged to engage said flexible mortises to secure said top member to the side members of the table.

2. A legless storage and play table as recited in claim 1 wherein said top member has a recessed top surface operatively arranged to receive and hold a secondary play surface member.

3. A legless storage and play table as recited in claim 2 and further including said secondary play surface member.

4. A legless storage and play table as recited in claim 3 wherein said secondary play surface member contains a plurality of male nubs operatively arranged to mate with female elements of interlocking building blocks.

5. A legless storage and play table for use by children, comprising:

a plurality of side members arranged in a polygon, where each side member has a trough-like section extending outwardly with respect to said table;

fastening means for connecting the plurality of side members together to form said table, wherein said fastening means comprise flexible mortises;

a bottom member operatively arranged to be secured to at least two of said side members;

wherein said bottom member and said plurality of side members define a storage chamber; and, a top member having a plurality of tenons operatively arranged to engage said flexible mortises to secure said top member to the side members of the table.

6. A legless storage and play table for use by children, comprising:

a first member operatively arranged to form a first side of said table, said first member having a trough-like section extending outwardly with respect to said table;

a second member operatively arranged to form a second side of said table in parallel spaced relationship to said first side, said second member having a trough-like section extending outwardly with respect to said table;

a third member operatively arranged to form a third side of said table positioned perpendicularly to said first and second sides, said third member having a trough-like section extending outwardly with respect to said table;

a fourth member operatively arranged to form a fourth side of said table in parallel spaced relationship to said third side, said fourth member having a trough-like section extending outwardly with respect to said table;

fastening means for connecting the four members together to form a rectangularly shaped table, wherein said fastening means comprise flexible mortises;

a bottom member operatively arranged to be secured to at least two of said side members;

wherein said four members and said bottom member define a storage chamber; and, a top member having a plurality of tenons operatively arranged to engage said flexible mortises to secure said top member to the side members of the table;

wherein at least two parallel spaced members contain a first row of collinear protuberances extending inwardly with respect to said table, and a second row of collinear protuberances extending inwardly with respect to said table in spaced parallel relation to said first row, wherein said first and second rows define a groove, and wherein said bottom member is operatively arranged to be secured within said groove.

* * * * *